United States Patent [19]

Dimier et al.

[11] Patent Number: 4,746,139

[45] Date of Patent: May 24, 1988

[54] MODIFIED UNIVERSAL SKI BINDING FOR USE WITH DIFFERENT SKI BOOTS, AND BOOTS SPECIFIC TO CERTAIN BINDINGS

[75] Inventors: Jean-Pierre Dimier, Rumilly; Roger Pascal, Annecy Le Vieux, both of France

[73] Assignee: Salomon S.A., Annecy, France

[21] Appl. No.: 690,882

[22] Filed: Jan. 14, 1985

[30] Foreign Application Priority Data

Jan. 12, 1984 [FR] France ..... 84 00390

[51] Int. Cl.[4] ..... A63C 9/084

[52] U.S. Cl. ..... 280/631

[58] Field of Search ..... 280/612, 618, 620, 625, 280/631, 632, 611; 36/117

[56] References Cited

U.S. PATENT DOCUMENTS

| | | | |
|---|---|---|---|
| 3,448,989 | 6/1969 | Marker | 280/11.35 |
| 3,709,509 | 1/1973 | Hildebrand | 280/11.35 T |
| 4,168,084 | 9/1979 | Von Besser et al. | 280/618 |

FOREIGN PATENT DOCUMENTS

| | | |
|---|---|---|
| PS278608 | 5/1969 | Austria . |
| PS307939 | 9/1972 | Austria . |
| 2041239 | 3/1972 | Fed. Rep. of Germany . |
| 2038995 | 3/1974 | Fed. Rep. of Germany . |
| 2808131 | 9/1979 | Fed. Rep. of Germany . |
| 1487281 | 6/1967 | France . |
| 2370489 | 6/1978 | France . |
| 2497110 | 7/1982 | France . |
| 8310819 | 12/1984 | France . |
| 8310989 | 1/1985 | France . |
| 2555907 | 6/1985 | France . |

OTHER PUBLICATIONS

Industry Standard DIN 7880, Part 1, with French translation.

Industry Standard DIN 7880, Part 2.

Industry Standard ONORM S 4035 and S 4036.

*Primary Examiner*—Richard A. Bertsch

*Assistant Examiner*—Richard Camby

*Attorney, Agent, or Firm*—Sandler & Greenblum

[57] ABSTRACT

A ski boot, and a binding for binding the ski boot onto the ski. The boot is provided with blocking means which prevents its attachment by bindings other than those which should properly be used with the specific boots. The binding itself however is capable of use with any standardized boot, whether or not it has blocking means. This assures that boots requiring specially modified bindings will not be used otherwise, but nevertheless permits the use of such boots with bindings used with standardized boots having no blocking means.

3 Claims, 9 Drawing Sheets

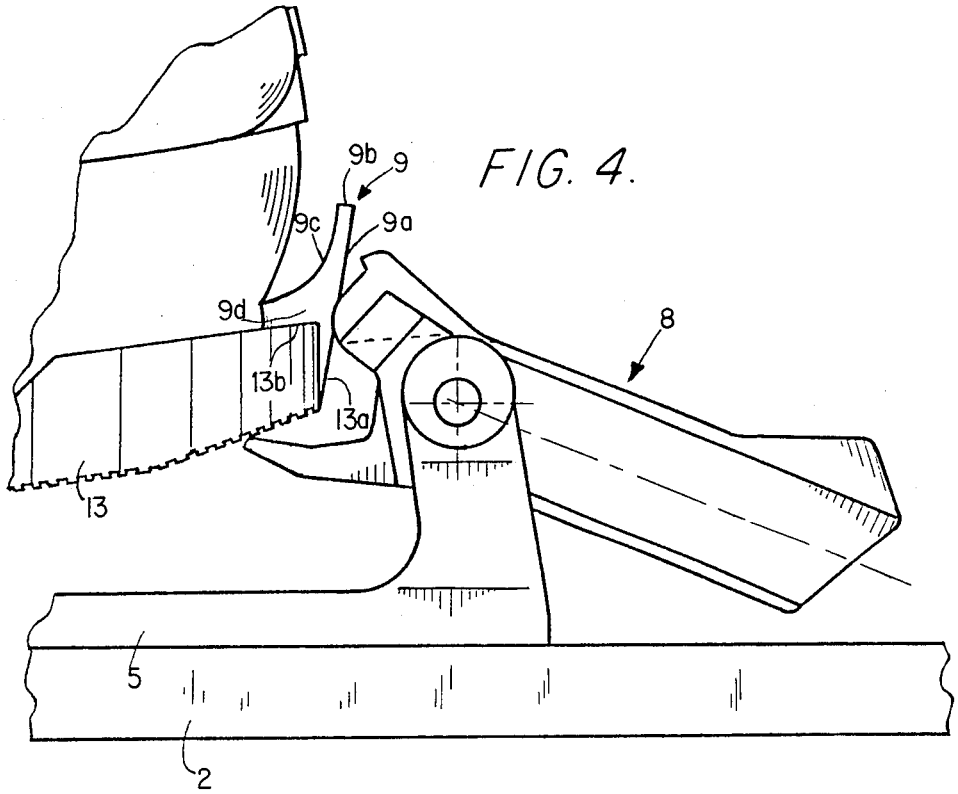
FIG. 4.
FIG. 6.
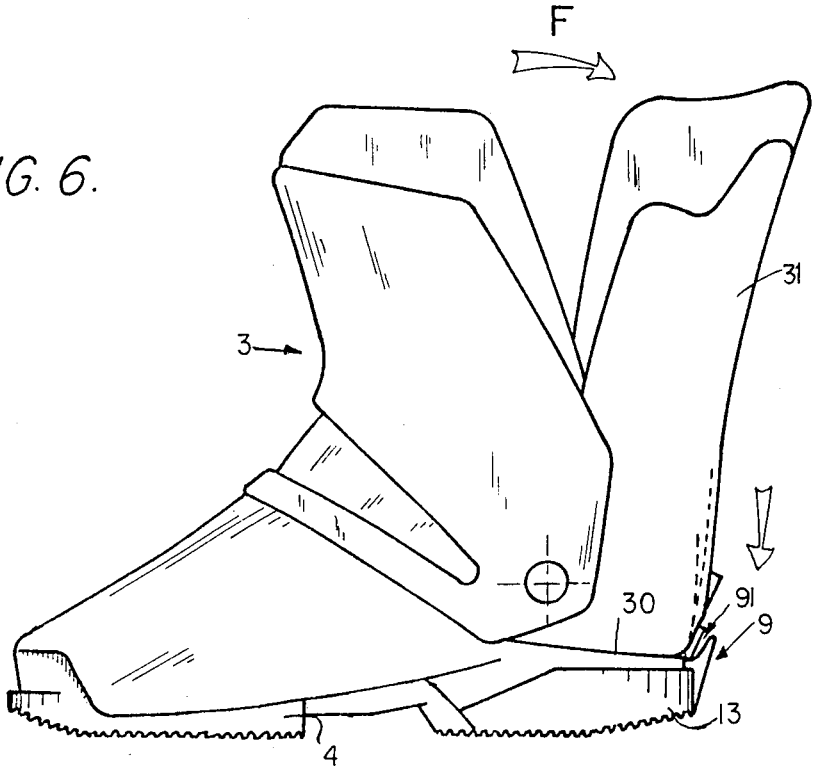

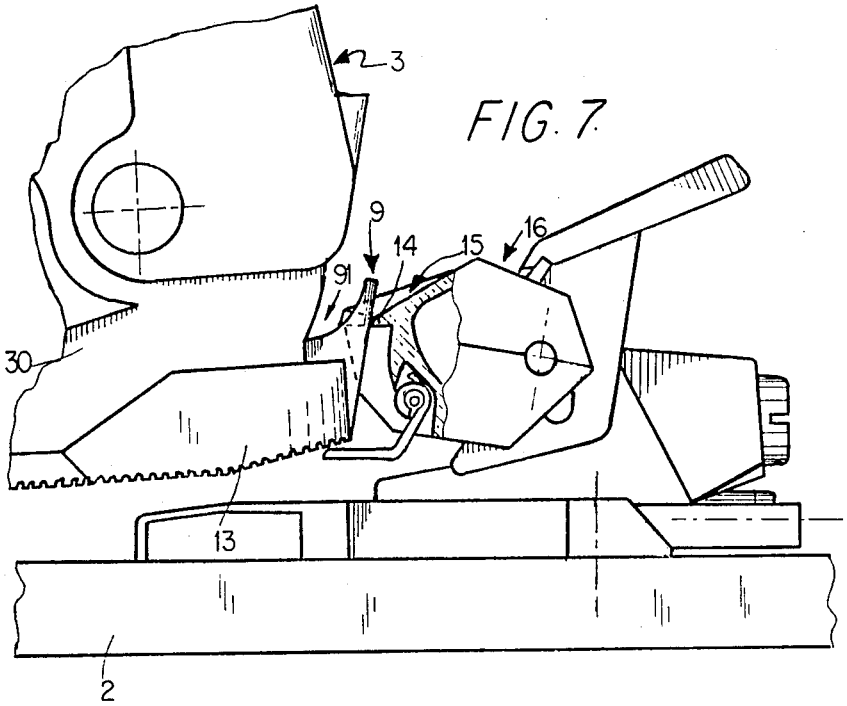
FIG. 7.
FIG. 8.
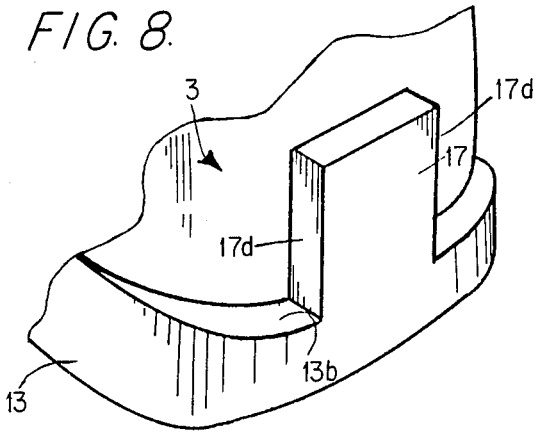

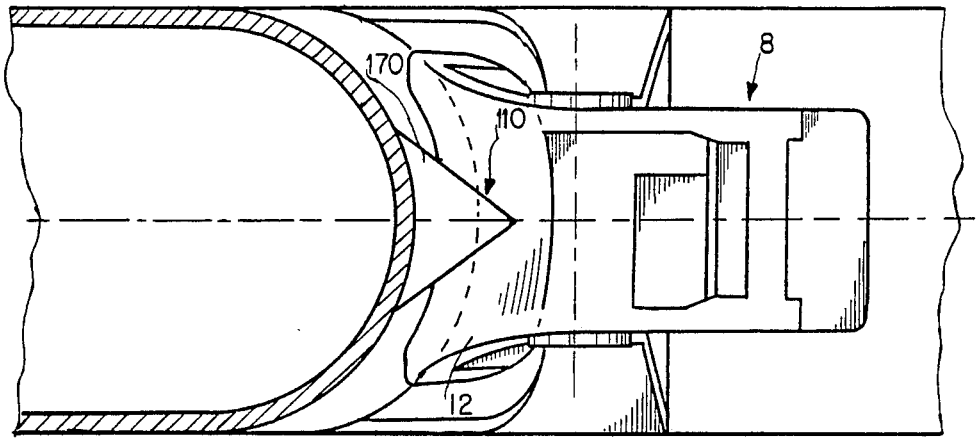
FIG. 12.
FIG. 13.
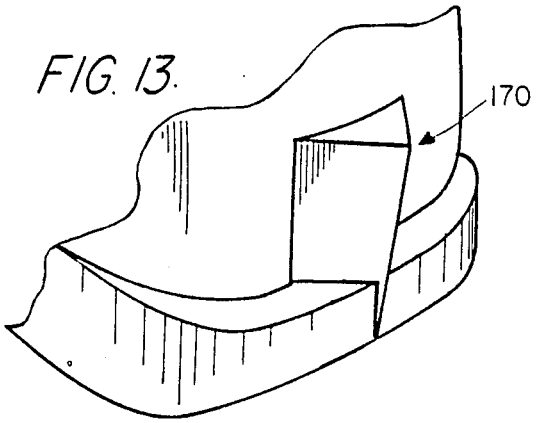

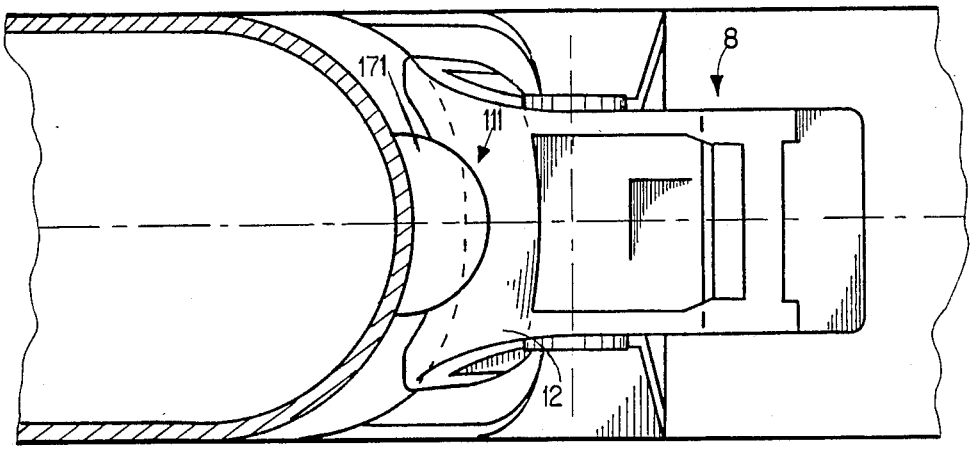
FIG. 14.
FIG. 15.
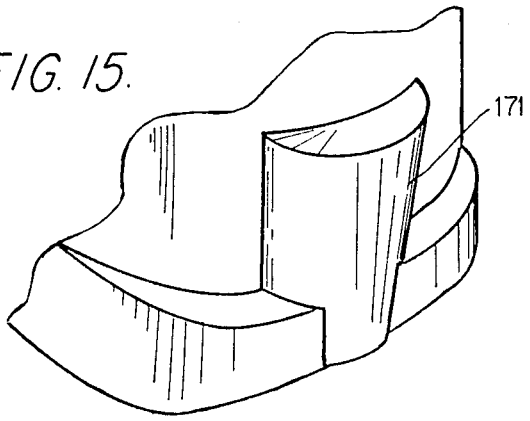

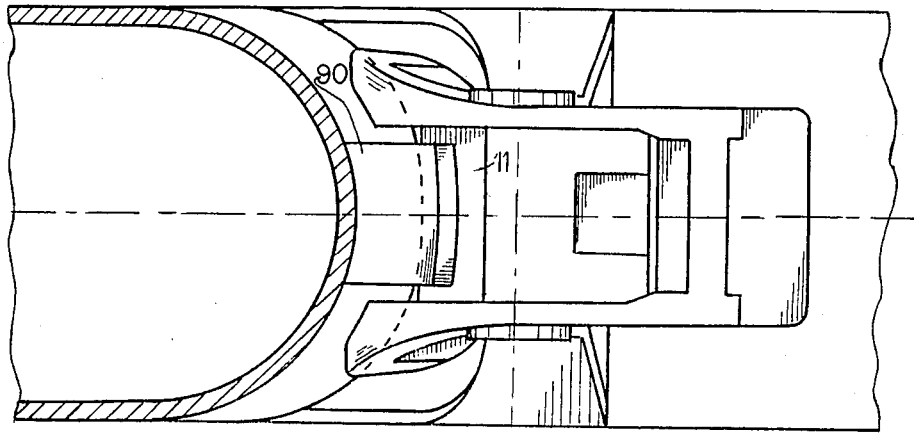
FIG. 16.
FIG. 17.
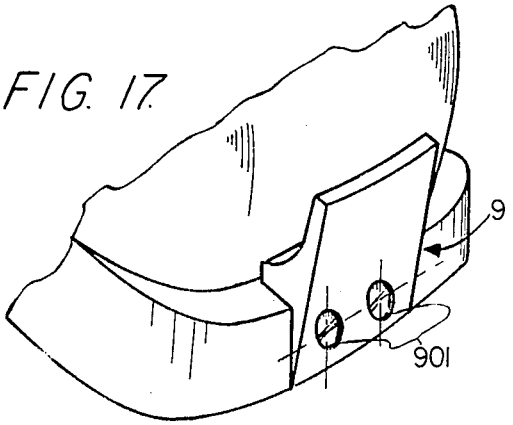
FIG. 18.
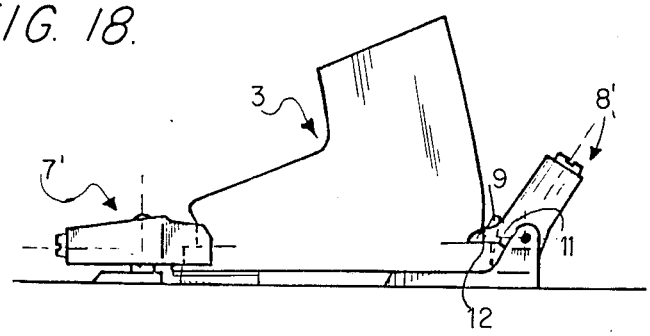

MODIFIED UNIVERSAL SKI BINDING FOR USE WITH DIFFERENT SKI BOOTS, AND BOOTS SPECIFIC TO CERTAIN BINDINGS

BACKGROUND OF THE INVENTION

1. Field of the Invention

The present invention relates to ski boots which require specialized bindings, and to modified universal bindings capable of use with such types of boots, as well as others. The bindings are to be mounted on a ski such that they can bind any type of standardized boot, including those boots which require specialized bindings.

2. Description of Background

Ski boots are known whose vamps and uppers are formed in different ways but whose front and rear ends comprise zones which are standardized both as to their configuration and dimension. Present standards utilized for all ski boot manufacturers are those which have been developed by the German and Austrian Institutes of Standardization. The standards are known as ONORM and DIN, and the standards of each of the Institutes relative to the dimensions and configurations of boots to allow for their attachment on conventional bindings serve as the definition of what is meant by the terms "standard" and "standardized" as used in this application. As of this time time the relevant standards are ONORM S4035 and S4036, and DIN standards 7800 parts 1 and 2, although it is understood that if these standards ever change or are supplanted by another series of standards, that it is the prevailing standards which are intended by this application. These norms call for standardized retention zones adapted to cooperate with corresponding zones of the binding to assure the maintenance and safe attachment of the boot on the ski, against bias exerted by the boot on the jaw of the binding, and to allow both for insertion of the boot into the binding and release of the boot from the binding when the force exerted on the boot exceeds a predetermined threshold.

These standardized retention and free or non-retention zones provided on the two ends of the boot, are constituted, for example, by a set thickness or height of the sole, a set width of the upper horizontal edge of the sole, a set height of the lower portion of the upper or the vamp which is positioned facing the binding, etc. These standardized retention zones are provided to allow for the use of boots of different types with a single type of safety binding or for the use of a given type of ski boot with different types of bindings.

Yet, it can be essential under certain circumstances to discriminate and distinguish boot types to provide for the dedicated use of a given type of ski boot with only one type of binding specially adapted for the boot. Such is the case, for example, if the boot is provided with an anti-skid sole made of rubber or similar material, so as to allow for walking. In this case, it becomes necessary to use only specialized bindings which comprise, for example, a moveable or pivotable plate which is interposed between the sole of the boot and the upper surface of the ski to minimize friction between the sole and the ski. If such a specialized binding is not utilized, the unwary skier may find that his foot is not released during a fall because of the additional frictional resistance exerted by the boot sole on the ski when release should normally occur. This may jam the boot and be very dangerous.

One can cite, for example, bindings of the type described in French Patent Applications Nos. 83 10989, 83 10819, and 83 19397 filed by Applicant, the disclosures of which are herein incorporated by reference. To avoid dangerous accidents, it becomes imperative to assure that when using a ski boot provided with an anti-skid sole, that it may be used with only a binding which is adapted specifically for this type of use such that the nature and actual form of the sole has no influence on the release of the boot. This might be done by using non-standardized boot zones which are capable of use with only specialized bindings.

However, while a non-standardized binding incapable of accepting standardized boots might well suit the desired function under such circumstances, this would, in effect, undesirably limit the use of the binding to only such specialized boots. It would be more desirable if the binding could be somewhat universal in nature, i.e., accept a plurality or even all types of boots, including specialized boots, provided that the boot comprises the standardized retention and free zones previously described.

SUMMARY OF THE INVENTION

It is the aim of the present invention to provide improvements to an assembly constituted by a safety binding and a ski boot wherein the boot can be used only with universal bindings which have been modified so as to permit use with the specialized boots.

It is a further object of the invention to provide boots which have otherwise standardized retention zones but which are modified to prevent use with conventional universal bindings which have not been specially modified so as to prevent utilization of the ski boot with a safety binding other than that with which it can be safely utilized.

It is yet another object of the invention to provide a modified universal binding capable of use with all boots having standardized retention and free or non-retention zones, as well as with boots which have specially modified zones which prevent their use other than with specially modified bindings.

The objectives of the invention are achieved by virtue of the ski boot according to the invention which comprises standard retention and free or non-retention zones at at least one of its ends to allow for the insertion of the boot into a binding adapted to secure a boot having standardized retention and free zones on at least one of its ends onto a ski. According to the invention the boot is prevented from being secured by the binding by blocking means on the boot.

As will be explained below, the term "standard" has a particular meaning and refers to the standards set by the appropriate agencies. For example, presently standardized retention and free zones conform to ONORM standard S4035 and S4036 and DIN standard 7880 standards 1 and 2.

The blocking means may be a projection positioned on the ski boot to project into the at least one retention and free zone of the binding to prevent the ski boot from being secured by the binding.

In one embodiment the blocking means is a projection mounted on the rear of the ski boot which prevents the rear portion of the binding from securing the heel of the ski boot. The blocking means may be a projection which extends rearwardly and upwardly from the rear portion of the boot. Alternatively, the blocking means may be a projection mounted on the front of the ski boot which prevents the front portion of the binding from securing the front of the ski boot.

The blocking means may be a projection molded onto the sole of the ski boot, or molded together with the sole of the ski boot. Alternatively, the blocking means is a projection secured onto the ski boot by attachment means such as screws.

The projection may have a variety of configurations, e.g., a generally rectangular configuration; a triangular projection having its base on the boot with one apex of the triangle projecting into the binding to prevent insertion of the boot; or a projection having its base secured onto the boot with a generally semi-circular surface projecting towards the binding to prevent insertion of the boot.

A space may be provided between the rear lower portion of the upper and the projection to allow for the rearward pivoting of at least a portion of the upper, e.g., the rear spoiler.

The boot itself may have a sole with an anti-skid surface which would normally be dangerous to the user if the boot were secured onto a ski by means of a ski binding requiring the boot to pivot directly on the ski during release of the boot.

The invention also relates to what is characterized in this application as a "modified universal ski binding" for attachment of a ski boot onto a ski. The modified universal binding may comprise, for example, a jaw having a median portion having a cut-away portion adapted to receive a projection positioned at a corresponding position on the boot which prevents the boot from insertion into standardized bindings suited to bind ski boots having standardized retention and free zones. In this way, the binding is capable of accepting boots, whether or not they have projections thereon. As noted above, the standardized retention and free zones conform to ONORM standard S4035 and S4036 and DIN standard 7880 parts 1 and 2.

The cut-away portion forms a receptor seat for the projection. The receptor seat may have a variety of configurations, e.g., a generally rectangular configuration; a curved configuration; or a triangular configuration.

The seat may be provided either at the front and/or rear portion of the binding to match with the corresponding projection.

The modified universal binding may in one embodiment be one further comprising a pivotable plate which is pivotable to facilitate release of boots having an anti-slip sole.

More generally, the invention relates to the combination of a modified universal binding adapted to be mounted on a ski, and a ski boot. The modified universal binding comprises, for example, at least one jaw for securing the boot to the ski. The boot comprises at each of its ends a standardized retention and free zone adapted to cooperate with at least one corresponding zone on the jaw of the binding to allow for the insertion of the boot and the safe maintenance of the boot on the ski. At least one of the ends of the boot comprises a blocking means adapted to engage a corresponding portion provided on the jaw of the binding in a manner so as to allow for the utilization of the boot only with modified bindings having standardized retention and free zones adapted whereby the blocking means does not interfere with insertion of the boot into the binding.

The blocking means prevents insertion of a boot having at least one standardized retention and free zone into an otherwise unmodified binding having standardized retention and free zones. The modified universal binding is adapted for use with boots having the standardized retention and free zones whether or not they comprise the blocking means.

The portion on the binding corresponding to the projection comprises a cut-away portion having a receptor seat therein which may have a configuration which is substantially complementary to the configuration of the blocking means.

The blocking means may be a projection comprising two lateral retention surfaces adapted to cooperate with corresponding surfaces provided within the receptor seat. The cooperation between the retention surfaces of the projection and the corresponding surfaces of the seat assures lateral retention of the boot on the ski. In this embodiment, the width of the projection in the horizontal direction defined as the distance between the retention surfaces substantially corresponds to that of the receptor seat in which it is to be tightly retained, whereby the projection contributes to the lateral retention of the ski boot.

Alternatively, the blocking means may be a projection freely engaged in the opening with a lateral play whereby the projection does not substantially contribute to retention including vertical and lateral retention of the boot.

Rather than using a receptor seat whose perimeter is completely defined, the receptor seat may be constituted by a free space provided above the jaw of the binding. The free space may be on the upper horizontal surface of the jaw and have a width greater than the width of the projection whereby the boot is not laterally secured within the modified universal binding by means of the projection.

The free space may be bounded on the bottom by a surface having a recess therein to permit the projection to pivot downwardly in response to a frontward fall.

BRIEF DESCRIPTION OF THE DRAWINGS

The invention will now be described with reference to certain non-limiting examples of various embodiments of the present invention with reference to the annexed drawings in which:

FIG. 4 is an elevational view of the rear binding with the boot in the raised position during insertion into the rear portion of the boot;

FIG. 6 is a side elevational view of the ski boot separated from the safety binding having a pivotable plate;

FIG. 7 is a side elevational view of the rear portion of a ski boot cooperating with a rear binding mounted directly on the ski, with partial cross section of the jaw;

FIG. 8 is a rear perspective view of the rear portion of the boot having an alternative embodiment of the projection;

FIGS. 12 and 13 illustrate an alternative embodiment wherein:

FIG. 12 is a view similar to that of FIG. 3, while FIG. 13 is a view similar to that of FIG. 8;

FIGS. 14 and 15 illustrate another alternative embodiment wherein:

FIG. 14 is a view similar to FIG. 3 while FIG. 15 is a view similar to that of FIG. 8;

FIG. 16 is a view similar to FIG. 3 illustrating yet another embodiment;

FIG. 17 is a perspective view illustrating another alternative embodiment of the invention; and FIG. 18 is another embodiment illustrated schematically.

DESCRIPTION OF PREFERRED EMBODIMENTS

Figure 1:
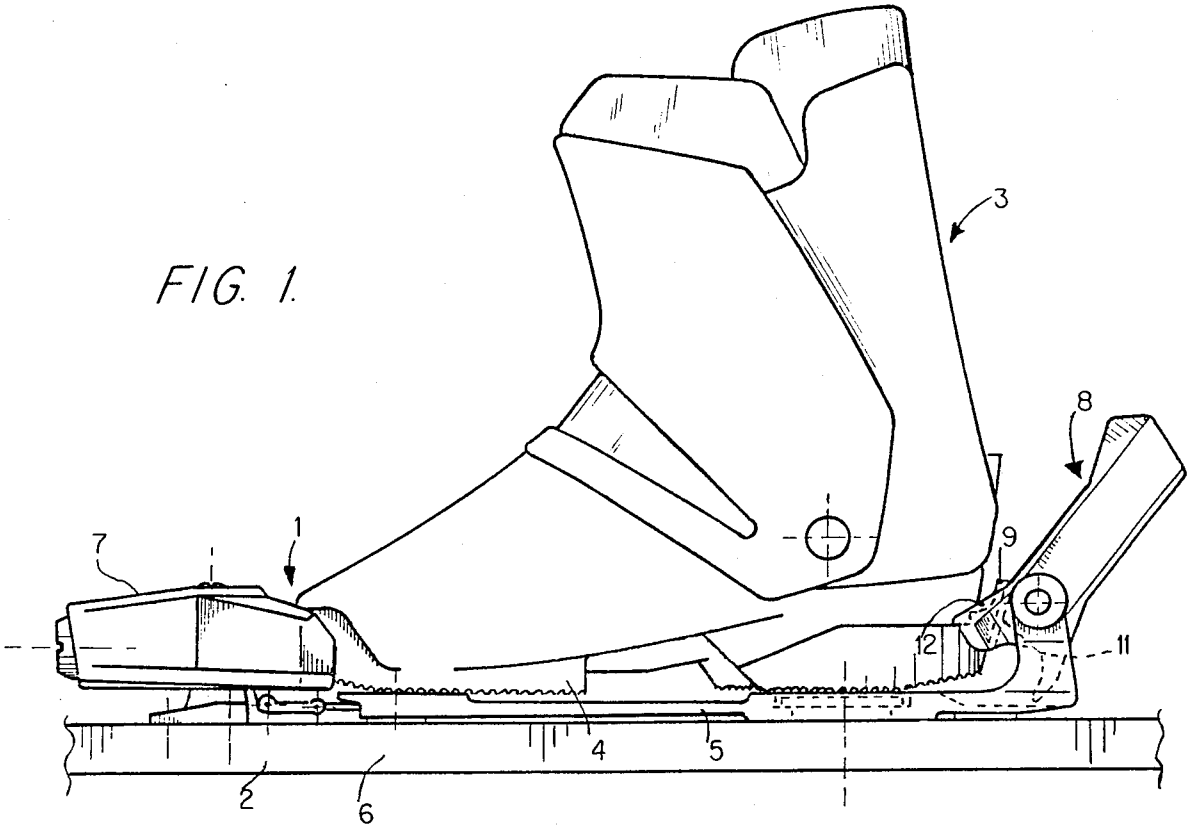
FIG. 1 is a side elevational view of an assembly constituted by the safety binding of the pivotable-plate type, and a ski boot provided with a projection at the rear end of the sole.
Figure 2:
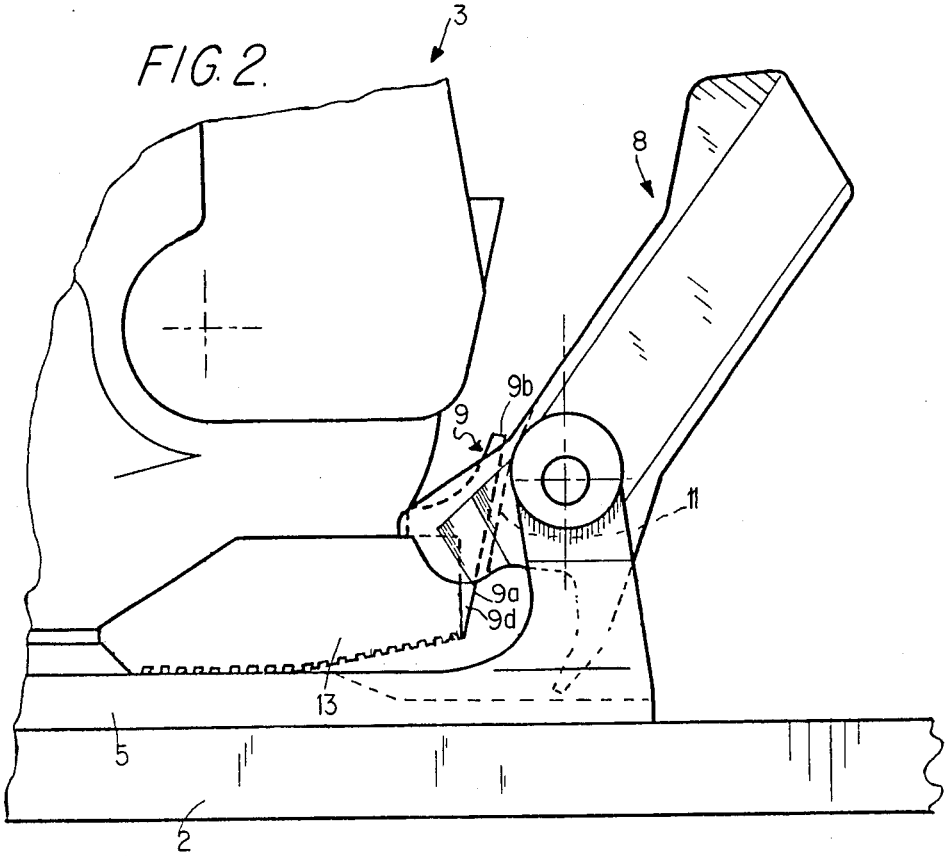
FIG. 2 is a partial elevational view, on a larger scale, of the rear portion of the boot and of the rear binding, with the boot in the inserted position.

To achieve the objectives set forth above, the assembly is constituted by a safety binding mounted on a ski in combination with a ski boot. The boot comprises at its ends zones of retention and disengagement which are standardized and which are adapted to cooperate with corresponding zones on the jaw of the binding to allow for the insertion of the boot and the safe maintenance of the boot on the ski. At least one of the ends of the boot comprises a portion which projects with respect to the standardized zones and is adapted to engage in a corresponding cut-away portion provided on the jaw of the binding in a manner such as to allow for the utilization of the boot with its projection only with a binding which has been specifically modified to have a cut-away portion, while the binding allows for the utilization and the retention of all boots having the standardized zones with or without the projection.

The projection of the boot can be formed by molding onto the sole, or furthermore it can be molded therewith or can be constituted by an element which is added thereto so as to assure that a projection exists.

The projection may or may not contribute to the retention of the boot on the ski. In the first case, the width of the projection, i.e., its extension in the transverse direction, corresponds to that of a receptor seat in which it is tightly retained. In the second case the projection is freely engaged in the seat with a lateral play such that the seat does not contribute to retention including vertical and the lateral retention of the boot. In either case the boot is adapted whereby portions other than the projection contribute to release during a fall.

FIGS. 1–5 illustrate an assembly according to the invention which comprises a safety binding 1 mounted on a ski 2 and, on the other hand, a ski boot 3. The boot comprises in the normal manner, at its front and rear ends, standardized retention zones which cooperate with corresponding zones on the binding to assure the safe maintenance of the boot 3 on the ski. More particularly, in the non-limiting example illustrated in the drawing, boot 3 is of the type which comprises a sole 4 which is anti-slip and is made out of rubber or similar material. Such a boot must be utilized with a binding 1 which is specially adapted to this type of boot. Binding 1 is of the type having an interposed plate 5 which is interposed between sole 4 and the upper surface of the ski 2. Plate 5 pivots around an axis 6 which is perpendicular to the upper planar surface of ski 2. Boot 3 is held in front by a front abutment 7 which is integral with ski 2, and, at the rear, by a rear binding 8 which, in the embodiment shown is itself, integral with the rear portion of pivotal plate 5.

So as to prevent ski boot 3 which is provided with an anti-slip sole 4 from being utilized with bindings of a conventional nature which are not specifically adapted to secure such a boot and which would pose a dangerous situation for the skier by virtue of the particular anti-slip sole 4, a projection 9 is provided at one of the ends, e.g., the rear end 3 in the embodiment shown.

Projection 9 is adapted to engage in a receptor seat 11 provided in the central portion of rear jaw 12 of rear binding 8. Seat 11 opens to the front and has in horizontal cross section, a U-shape which is frontwardly directed. Projection 9 can be molded onto or be directly molded with the rear median portion of heel 13 of boot 3. More particularly with reference to FIG. 5, projection 9 may comprise, in a non-limiting embodiment, a rear transverse surface 9*a* which inclines from bottom to top towards the rear, beginning at the median portion of the lower edge of heel 13, an upper edge 9*b* which is relatively thin, an interior curved surface 9*c* running from upper edge 9*b* to the lower portion of the vamp of the boot, and two lateral vertical and longitudinal surfaces 9*d* beginning at the rear portion 13*a* of heel 13 and the upper edge 13*b* of the heel.

Projection 9 may or may not contribute to the lateral retention of ski boot 3 on ski 2. In the non-limiting example illustrated in FIGS. 1–5, projection 9 effectively contributes to this retention and to this end its width "a" (FIG. 3) i.e., its dimension in the horizontal transverse direction, or the distance between two lateral vertical surfaces 9*d*, is equal to the width of the receptor seat 11 provided in jaw 12 of heel binding 8, i.e., the distance between the two lateral internal surfaces 11*a* defining the seat 11. As a result, the two lateral and vertical surfaces 9*d* of projection 9 are engaged and in tight contact with the two internal vertical and longitudinal surfaces 11*a* defining seat 11. This cooperation assures a lateral retention at the location of the heel and the shocks are directly registered by this projection which assures greater safety while diminishing the risk of premature release.

It is seen, from the description above, that ski boot 3, provided at its rear end with projection 9, can be utilized only with a binding 1 whose rear binding 8 has been adapted so as to have, in its rear jaw 12, a receptor seat 11 for projection 9.

Even though projection 9 is preferably formed by being molded onto or molded directly with heel 13, it can likewise be constituted by an element which is otherwise secured onto the heel, i.e., by screws.

FIG. 7 illustrates a ski boot according to the invention, i.e., with a projection 9, in the course of an attempt to insert the boot into a traditional binding 16, i.e., a binding not having a receptor seat. It is seen, that under these conditions, insertion of the boot is not possible. In effect, the front median portion 14 of jaw 15 hits projection 9 and insertion of the boot is prevented, which of course prevents skiing from occurring.

In FIGS. 1–7 projection 9 is spaced from the shell base so as to create a seat 91 allowing for the passage of the lower portion of the rear spoiler 31 during its rearward pivoting along the direction of arrow F (FIG. 6).

Projection 9 can assume various geometric configurations different from those illustrated in FIGS. 1–7. For example, as is shown in FIG. 8, projection 17 can have a parallelopipedic configuration which extends upwardly from the upper horizontal edge 13*b* of heel 13.

Figure 9:
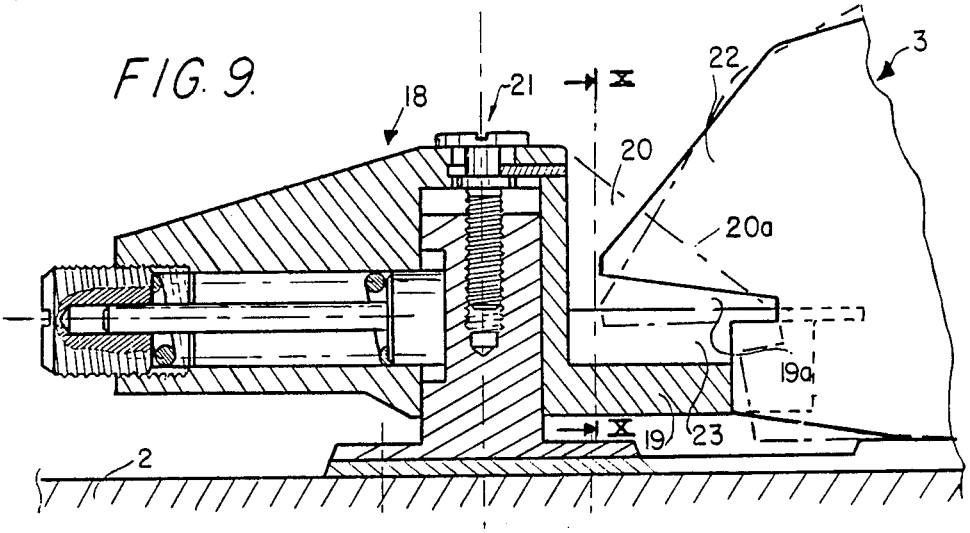
FIG. 9 is a longitudinal and vertical cross sectional view of a front binding with which the ski boot having a projection at its front end cooperates.
Figure 10:
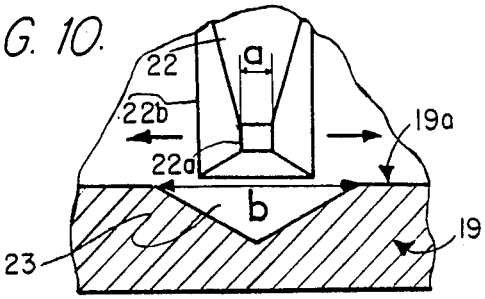
FIG. 10 is a vertical and transverse cross sectional view along line X—X of FIG. 9.
Figure 11:
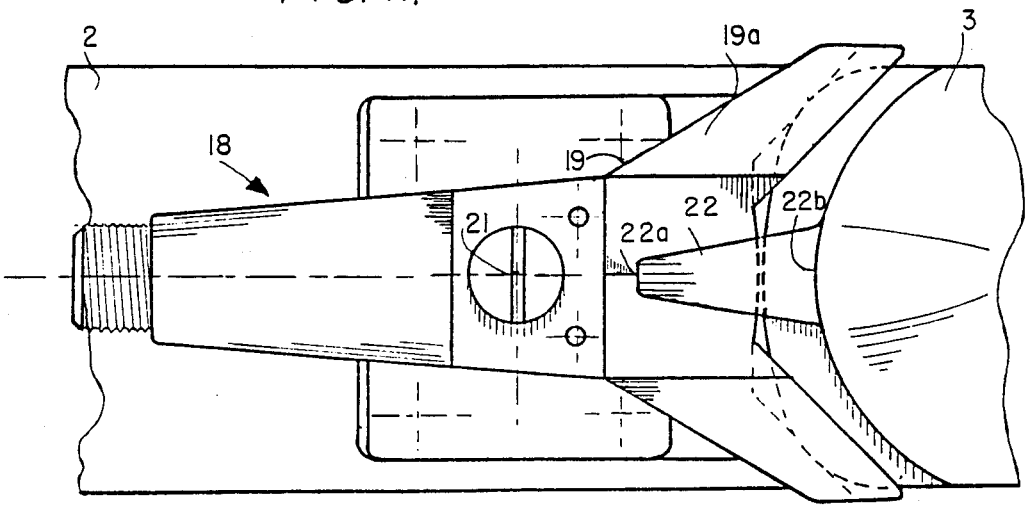
FIG. 11 is a top planar view of the front abutment and of the front portion of the boot shown in FIG. 9.

Referring now to FIGS. 9–11, an alternative embodiment is described in which ski boot 3 is retained on the ski, at its front end by a front abutment 18 which comprises a retention jaw 19 which can pivot around a vertical axis 21. Front abutment 18 comprises an elastic return mechanism for returning jaw 19 into a median engagement position which is that illustrated in the drawing.

To allow for the cooperation of ski boot 3 with only a single type of binding, the boot is provided at its front end with a projection 22 which extends into space 20 constituted by a free space provided above jaw 19. This space is obtained by eliminating, in a conventional retention jaw, the upper portion included between the posterior surface, inclined from top to bottom towards the rear of the jaw, this surface being indicated by dashed lines 20*a*. Horizontal plane 19*a* constitutes the upper surface of jaw 19 which is "amputated" when compared with a conventional jaw. Jaw 19 furthermore has a space 23 provided in the upper median portion which opens onto upper surface 19*a*. More particularly, space 23 can have a V or U cross section of a width "b" greater than the width "a" of projection 22. In this case projection 22 does not contribute to the lateral retention of the boot, a retention which is assured only by the cooperation of the standardized retention zones of the sole with the corresponding zones of jaw 19.

In the non-limiting embodiment shown in FIG. 11, projection 22 has substantially the form of an irregular truncated pyramid situated above opening 23, the truncated pyramid having, in front, a minor base 22*a* of width "a" connected, at its major base 22*b*, to the front portion of the upper of boot 3. This allows for a normal lateral release with projection 22 moving freely along the transverse direction of the arrows in FIG. 10, above the upper horizontal surface 19*a* of jaw 19.

Space 23 allows for a pivoting, in the opening, of front projection 22, in the event of a frontward fall, or during insertion to assure the normal operation of the rear binding so as to retain the rear portion of the boot.

Alternative embodiments of projections are shown in FIGS. 12–15.

Figure 3:
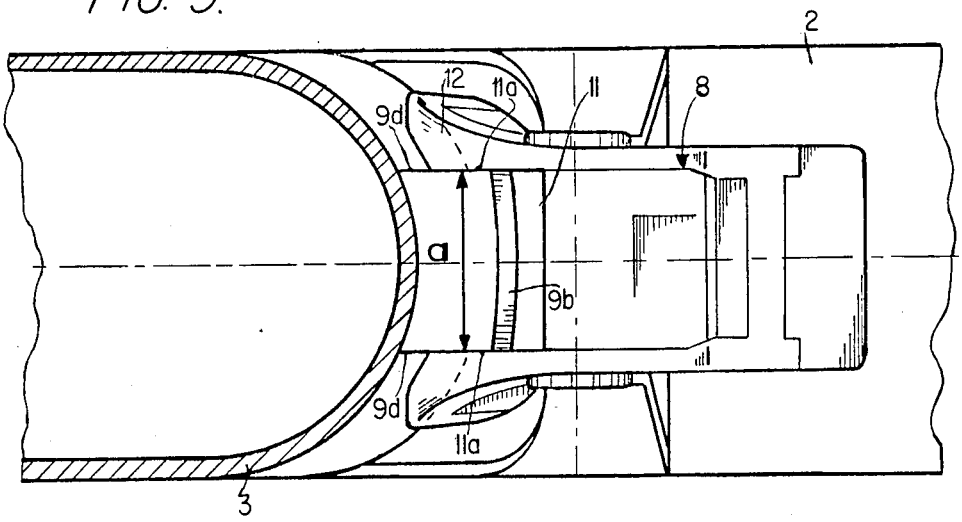
FIG. 3 is a top planar view of the rear binding of FIG. 2 with the rear portion of the ski boot in horizontal cross-section, the boot being in the inserted position.
Figure 5:
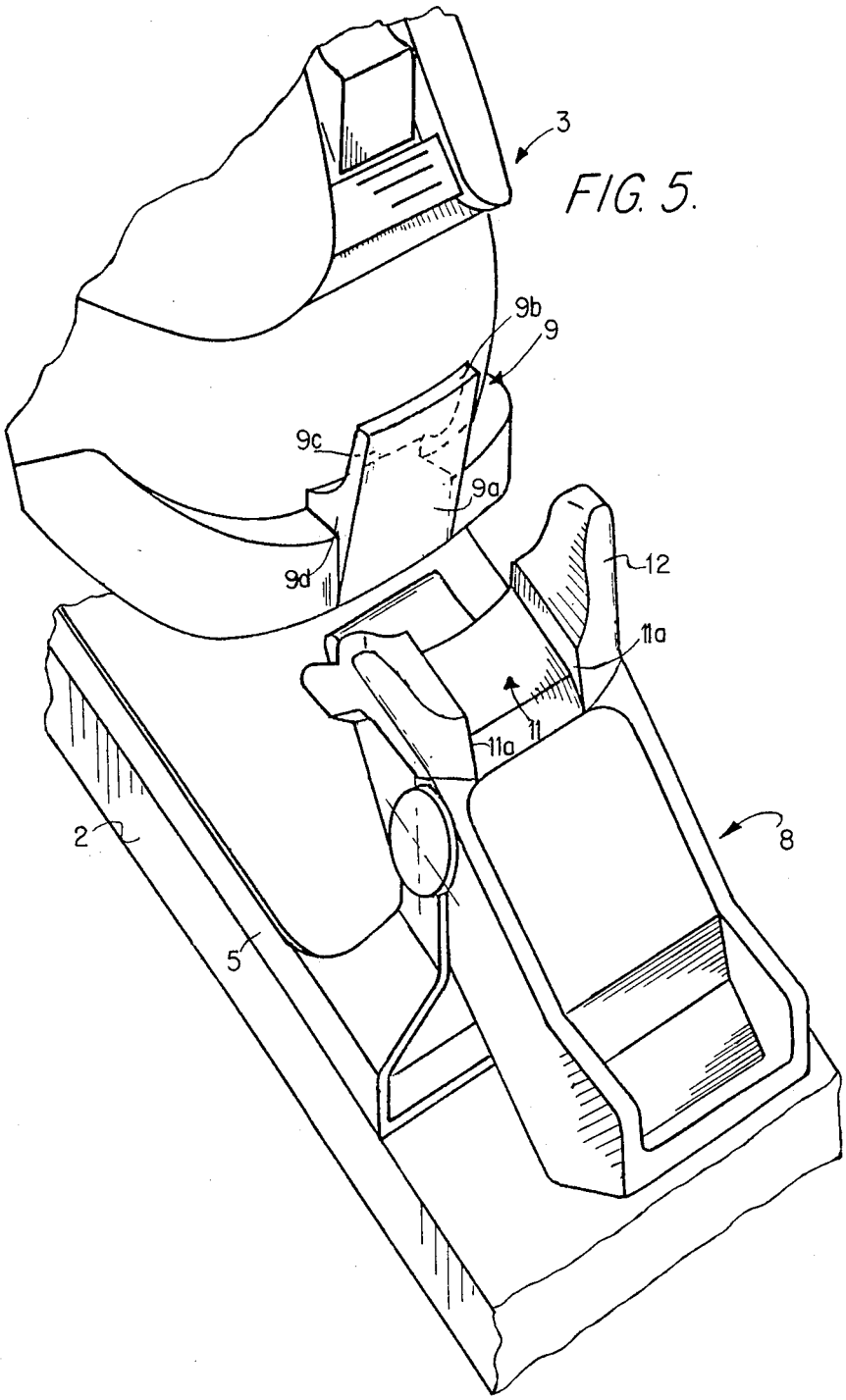
FIG. 5 is a rear perspective view of the rear portion of the boot and of the rear binding in the set position ready for insertion of the boot.

FIGS. 12 and 13 are similar to FIGS. 3 and 8 and illustrate an alternative embodiment in which projection 170 is provided at the rear of the boot in the form of a triangular projection which is pointed and which is directed towards the rear and cooperates with a seat 110 of complementary configuration, i.e., having a V shape which is open towards the front, provided in the median portion of jaw 12 of rear binding 8.

FIGS. 14 and 15 illustrate another embodiment in which projection 171 has a curved or semi-circular profile, with a rearwardly directed convexity extending upwardly and which cooperates, with the boot, in the inserted position, with a seat 111 of complementary curved configuration, i.e., having a frontwardly directed concavity, provided in the median portion of jaw 12 of rear binding 8.

FIG. 16 illustrates an alternative embodiment in which receptor seat 11 is wider than corresponding projection 90 which is provided in the rear portion of the boot such that projection 90 does not contribute to lateral retention.

FIG. 17 illustrates an alternative embodiment in which projection 9 is a separate element secured onto the heel by two screws 901.

FIG. 18 illustrates another assembly according to the invention. In this embodiment boot 3 is a boot similar, for example, to that shown in FIGS. 1–6 which comprises a projection 9 positioned in the rear portion of the boot which is retained by a binding 8' whose jaw 12 comprises a receptor seat 11. The front portion of the boot is, itself, retained on the ski by a binding 7' of the type described in French Patent Applications Nos. 82 2057 or 80 00863, the disclosures of which are herein incorporated by reference.

It will be noted that the boot according to the invention can be utilized only with universal bindings modified according to the invention. However, the binding itself can be utilized with any type of conventional boot on the condition that it comprises at least the standardized zones.

Of course, the invention relates as well to the boot itself, as well as to the binding for it; to the combination of the boot plus the binding; and even a ski equipped with such a combination.

Finally, although the invention has been described with respect to particular means, materials and embodiments, it should be understood that the invention is not limited to the particulars disclosed and extends to all equivalents within the scope of the claims.

What is claimed is:

1. In combination a modified universal binding adapted to be mounted on a ski and a boot, said modified universal binding comprising at least one jaw for securing said boot to said ski, said ski boot comprising at each of its ends at least one standardized retention and release zone comprising means for engaging at least one corresponding standardized retention and release zone on the jaw of said binding to allow for the insertion of the boot and the safe maintenance of the boot on the ski, and wherein at least one of the ends of said boot comprises a blocking means adapted to engage a corresponding portion provided on the jaw of the binding in a manner so as to allow for the utilization of the boot only with modified bindings having standardized retention and release zones adapted whereby the blocking means does not interfere with the insertion of the boot, said blocking means contributing substantially no retention including no lateral or vertical retention of said boot by said modified universal binding, said blocking means being a projection comprising a transverse posterior surface inclined from bottom to top towards the rear, beginning at the median portion of the lower edge of the heel of said ski boot, a relatively thin upper edge, an interior surface connecting the upper edge to the lower portion of the upper of the boot, and two vertical longitudinal lateral surfaces beginning at the posterior portion of the heel and the horizontal upper edge of the heel.

2. The combination as defined by claim 1 further comprising a receptor seat for receiving said projection, said receptor seat being provided in the central portion of the jaw of a rear binding.

3. The combination as defined by claim 2 wherein said receptor seat is frontwardly open and has a horizontal cross-section which is frontwardly directed and U-shaped.

* * * * *